US005680148A

United States Patent [19]

Okada et al.

[11] Patent Number: 5,680,148

[45] Date of Patent: Oct. 21, 1997

[54] DRIVING CIRCUIT FOR A DISPLAY APPARATUS CAPABLE OF DISPLAY OF AN IMAGE WITH GRAY SCALES

[75] Inventors: Hisao Okada, Ikama-gun; Tadatsugu Nishitani, Amagasaki; Toshihiro Yanagi, Nara, all of Japan

[73] Assignee: Sharp Kabushiki Kaisha, Osaka, Japan

[21] Appl. No.: 503,328

[22] Filed: Jul. 17, 1995

Related U.S. Application Data

[63] Continuation of Ser. No. 157,678, Nov. 24, 1993, abandoned.

[30] Foreign Application Priority Data

Nov. 25, 1992 [JP] Japan ..... 4-315421

[51] Int. Cl.[6] ..... G09G 3/36

[52] U.S. Cl. ..... 345/95; 345/89

[58] Field of Search ..... 345/89, 87, 88, 345/55, 63, 50, 51, 52, 211, 212, 95, 96, 97; 359/54, 56, 58, 59; 307/463

[56] References Cited

U.S. PATENT DOCUMENTS 5,010,327 4/1991 Wakita et al. ..... 340/784

5,196,738 3/1993 Takahara et al. ..... 345/89

5,266,936 11/1993 Saitoh ..... 345/89

FOREIGN PATENT DOCUMENTS 0 478 386 A2 1/1992 European Pat. Off. .

0484159 5/1992 European Pat. Off. ..... 345/89

0279000 2/1994 Japan .

*Primary Examiner*—Chanh Nguyen

*Attorney, Agent, or Firm*—David G. Conlin; William J. Daley, Jr.

[57] ABSTRACT

A driving circuit for a display apparatus is provided which apparatus includes pixels allowed to produce a display image by specific voltages applied thereto. The driving circuit includes: a first voltage output means for generating an interpolated voltage on the basis of gray-scale reference voltages supplied thereto, and applying the interpolated voltage to the pixels, the interpolated voltage being of a level between the voltage levels of the gray-scale reference voltages; and a second voltage output means for applying, to the pixels, a voltage different from the gray-scale reference voltages.

3 Claims, 7 Drawing Sheets

Tsmpn
OE
t
D0
D1
D2
D Q
CK
51
52
d0
d1
d2
S'0
S0
S2
S5
S7
53
V7
V5
V2
V0
V'0
54
55
56
57
58
On
50

DRIVING CIRCUIT FOR A DISPLAY APPARATUS CAPABLE OF DISPLAY OF AN IMAGE WITH GRAY SCALES

This is a continuation of application Ser. No. 08/157,678 filed Nov. 24, 1993, now abandoned.

BACKGROUND OF THE INVENTION

1. Field of the Invention

The present invention relates to a driving circuit for a flat panel display apparatus, and more particularly relates to a driving circuit for a display apparatus which receives a digital image signal to produce a display image with gray scales in accordance with the received digital image signals.

2. Description of the Related Art

FIG. 1 shows a data driver exemplifying a conventional driving circuit for driving a display apparatus which receives digital image data to produce a display image with gray scales in accordance with the received data. For simplicity of explanation, it is herein assumed that the digital image data consists of two bits ($D_0$, $D_1$). This data driver supplies driving voltages to N pixels (where N is a positive integer) on a scanning line which has been selected by means of a scanning signal.

FIG. 2 shows a circuit constituting part of the data driver of FIG. 1. This circuit, which is denoted by the reference numeral 20, supplies a driving voltage through a data line to the "n"th pixel (where n is an integer of 1 to N) of the above-mentioned N pixels provided along the single scanning line. The circuit 20 includes sampling (primary) flip-flops 21 each for receiving one bit of the digital image data ($D_0$, $D_1$), holding (secondary) flip-flops 22 each also for receiving one bit, a decoder 23 and four analog switches 24 to 27. To the analog switches 24 to 27, signal voltages $V_0$ to $V_3$ are respectively supplied from four different voltage sources. As the sampling flip-flops 21, D flip-flops or various other flip-flops can be used.

The circuit 20 shown in FIG. 2 operates as follows. On receiving the leading edge of a sampling pulse $T_{smpn}$ corresponding to the "n"th pixel, the sampling flip-flops 21 obtain the digital image data ($D_0$, $D_1$) and hold the thus obtained data therein. When such image data sampling for the 1st to Nth pixels on a single scanning line is completed (i.e., sampling corresponding to one horizontal period is completed), an output pulse OE is applied to the holding flip-flops 22. On receiving the output pulse OE, the holding flip-flops 22 obtain the digital image data ($D_0$, $D_1$) from the sampling flip-flops 21, and transfer the thus obtained digital image data to the decoder 23. The decoder 23 decodes each bit of the digital image data ($D_0$, $D_1$), and turns on one of the analog switches 24 to 27 in accordance with the respective values of the thus decoded bits. As a result, one of the signal voltages $V_0$ to $V_3$ from the four different voltage sources, which corresponds to the thus turned-on analog switch 24, 25, 26 or 27, is output from the circuit 20.

A conventional data driver such as described above requires $2^n$ different voltage sources (where n is the number of bits constituting digital image data). In other words, the number of required voltage sources doubles when the digital image data is enlarged by one bit. For example, in the case where the digital image data consists of 4 bits for the generation of a display image with 16 gray scales, the number of required voltage sources is: $2^4=16$. Similarly, in the case where the digital image data consists of 5 bits for the generation of a 32-gray-scale display image, the number of required voltage sources is: $2^5=32$. In the case of 6-bit digital image data for the generation of a 64-gray-scale display image, the number of required voltage sources is: $2^6=64$.

Such voltage sources are connected through the analog switches of the data driver to a display apparatus, e.g., a liquid crystal panel, which provides a heavy load on the voltage sources. Thus, each voltage source is required to have a sufficient performance to drive such a heavy load. The increase in the number of such high-performance voltage sources is a significant factor in the higher production cost of the entire driving circuit. Furthermore, since high-performance voltage sources cannot readily be placed within the LSI circuit constituting the driving circuit, they must be located outside the LSI circuit. This means that signal voltages for driving the liquid crystal panel must be supplied from external voltage sources to the LSI circuit. As a result, with an increase in the number of voltage sources, the number of input terminals of the LSI circuit must be increased accordingly. It is extremely difficult to produce an LSI circuit having such a large number of input terminals. Even if it is possible to make such an LSI circuit, mounting or manufacturing problems arise in the mass production thereof; it is practically impossible to mass-produce such LSI circuits.

An oscillating voltage driving method and a driving circuit using the method have been proposed by Japanese Patent Application No. 4-129164, which has not been published, in order to solve the problem of the above-described conventional driving method where the number of required voltage sources is equal to that of gray scales to be generated. In the proposed method and driving circuit, external voltage sources are provided to supply gray-scale reference voltages which are used to further obtain a plurality of interpolated voltages, so that both the gray-scale reference voltages and the interpolated voltages are used to generate gray scales. Thus, the number of gray scales which can be generated is larger than that of the voltage sources in the driving circuit. Several types of data driver using this oscillating voltage driving method have been put into practical use.

FIG. 3 shows a circuit 30 which constitutes part of a data driver exemplifying the above-described proposed driving circuit using the oscillating voltage driving method.

Table 1 shows the relationship between voltages $V_0$ to $V_7$ applied to a pixel from the circuit 30 and gray-scale reference voltages $V_0$, $V_2$, $V_5$ and $V_7$ respectively supplied from four voltage sources. As shown in Table 1, the four voltages $V_1$, $V_3$, $V_4$ and $V_6$ applied to the pixel from the circuit 30 are four interpolated voltages $(V_0+2V_2)/3$, $(2V_2+V_5)/3$, $(V_2+2V_5)/3$ and $(2V_5+V_7)/3$, respectively, which are obtained from the four gray-scale reference voltages $V_0$, $V_2$, $V_5$ and $V_7$. The gray-scale reference voltages $V_0$, $V_2$, $V_5$ and $V_7$ and the interpolated voltages $V_1$, $V_3$, $V_4$ and $V_6$ produced therefrom are all used to generate gray scales. This means that, in this data driver, eight gray scales can be obtained from only four gray-scale reference voltages which are respectively supplied from the four voltage sources.

TABLE 1

| $d_2$ | $d_1$ | $d_0$ | Voltage Applied to Pixel | |
|---|---|---|---|---|
| 0 | 0 | 0 | $V_0$ | $V_0$ |
| 0 | 0 | 1 | $V_1$ | $\frac{V_0+2V_2}{3}$ |

TABLE 1-continued

| $d_2$ | $d_1$ | $d_0$ | Voltage Applied to Pixel | |
|---|---|---|---|---|
| 0 | 1 | 0 | $V_2$ | V2 |
| 0 | 1 | 1 | $V_3$ | $\frac{2V_2+V_5}{3}$ |
| 1 | 0 | 0 | $V_4$ | $\frac{V_2+2V_5}{3}$ |
| 1 | 0 | 1 | $V_5$ | $V_5$ |
| 1 | 1 | 0 | $V_6$ | $\frac{2V_5+V7}{3}$ |
| 1 | 1 | 1 | $V_7$ | $V_7$ |

As described above, the proposed driving circuit using the oscillating voltage driving method is advantageous in that the number of gray scales which can be obtained is greater than that of the voltage sources. This conventional driving circuit, however, involves such problems as will be described below.

FIG. 4 shows the relationship between voltage applied to a pixel by the above-described circuit 30 and the resultant transmittance of the pixel. The problems to be solved by the invention will be described by taking the voltage $V_0$ as an example. The voltage $V_0$ is used to obtain the lowest transmittance, i.e., the highest gray scale (black).

As shown in FIG. 4, in the range of high voltage levels which result in transmittances close to 0%, the transmittance gradually approaches 0% with an increase in the voltage. Thus, as the absolute value of the voltage $V_0$ is increased to a practically possible level, the transmittance approaches 0%. In the circuit 30, the gray-scale reference voltage $V_0$ is used to obtain the interpolated voltage $V_1$ as shown in Table 1, so that it is extremely difficult to adjust the gray-scale reference voltage $V_0$ and the interpolated voltage $V_1$ separately. When the voltage $V_1$ is so adjusted that an appropriate gray scale can be obtained by the application of the voltage $V_1$ to the pixel, the voltage $V_0$ is determined in accordance with the voltage $V_1$. Conversely, when the voltage $V_0$ is so adjusted that an appropriate gray scale can be obtained by the application of the voltage $V_0$ to the pixel, the voltage $V_1$ is determined in accordance with the voltage $V_0$. In this example, the voltage $V_0$ is used to produce only the interpolated voltage $V_1$. With an increase in the number of bits constituting a digital image signal, however, the number of interpolated voltages to be obtained from the voltage $V_0$ increases. This makes it far more difficult to separately adjust the voltage $V_0$ and the interpolated voltages to be produced therefrom. Therefore, this conventional driving circuit involves the following inconvenience: For example, even in the case where a slight increase in the voltage $V_0$ would further darken a black image (i.e., a highest-gray-scale image) to obtain higher contrast in the entire display image, it is impossible to actually increase the voltage $V_0$ without adversely affecting the other gray scales such as those obtained by interpolated voltages; even the slight increase in the voltage $V_0$ can deteriorate the characteristics of the gray scales of the entire display image. Therefore, a display apparatus using this conventional driving circuit cannot produce a high-contrast display image. This problem also arises in the case of the voltage $V_7$ which is used to obtain the highest transmittance, i.e., the lowest gray scale (white).

SUMMARY OF THE INVENTION

The driving circuit for a display apparatus includes pixels which are allowed to produce a display image by specific voltages applied thereto, wherein the driving circuit comprises: a first voltage output means for generating an interpolated voltage on the basis of gray-scale reference voltages supplied thereto, and applying the interpolated voltage to said pixels, the interpolated voltage being of a level between the voltage levels of the gray-scale reference voltages; and a second voltage output means for applying, to said pixels, a voltage different from said gray-scale reference voltages.

In one embodiment of the present invention, the voltage applied to said pixels by said second voltage output means is used to obtain a highest gray scale.

In another embodiment of the present invention, the voltage applied to said pixels by said second voltage output means is used to obtain a lowest gray scale.

Thus, the invention described herein makes possible the advantages of providing a driving circuit for a display apparatus, in which a voltage for the generation of the highest or lowest gray scale, or voltages for the generation of both the highest and lowest gray scales are provided separately from gray-scale reference voltages, so that the voltage(s) for the highest and/or lowest gray scale(s) can be adjusted separately from the gray-scale reference voltages, thereby allowing the display apparatus to produce a display image having the highest contrast possible for a liquid crystal panel.

These and other advantages of the present invention will become apparent to those skilled in the art upon reading and understanding the following detailed description with reference to the accompanying figures.

DESCRIPTION OF THE PREFERRED EMBODIMENTS

The invention will be further described by reference to examples. A matrix-type liquid crystal display apparatus is herein used as a display apparatus to be driven by a driving circuit according to the invention. But it is understood that the driving circuit of the invention can also be applied to other types of display apparatus.

Figure 1:
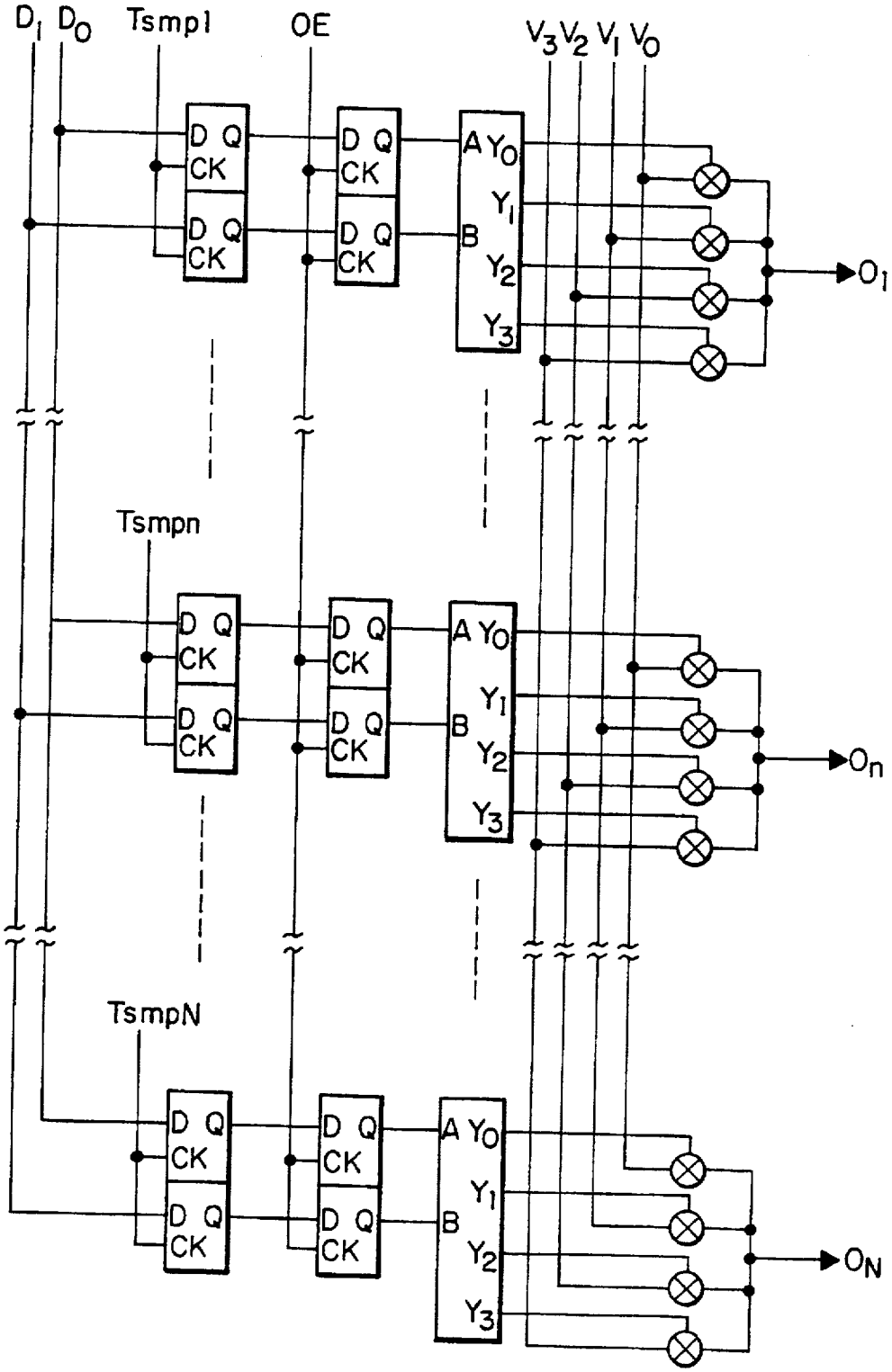
FIG. 1 (PRIOR ART)
FIG. 1 is a schematic diagram showing the circuit of a conventional data driver.
Figure 2:
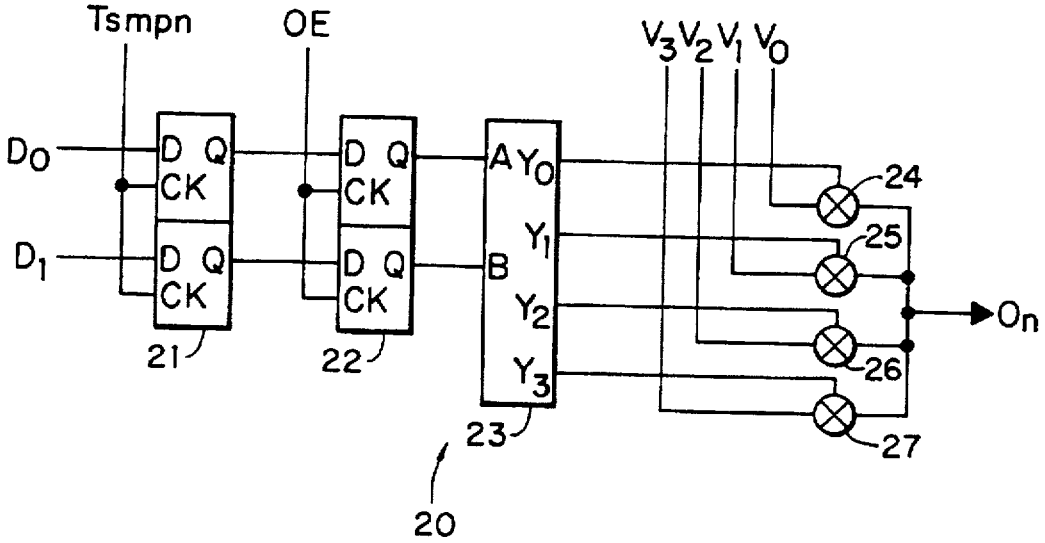
FIG. 2 (PRIOR ART)
FIG. 2 is a schematic diagram showing a circuit constituting part of the conventional data driver of FIG. 1.
Figure 3:
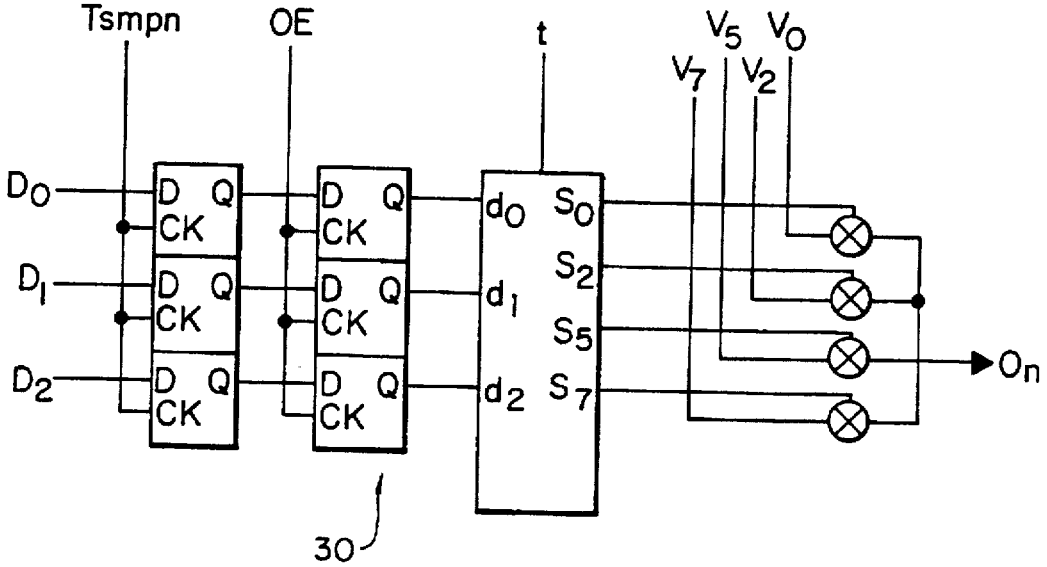
FIG. 3 is a schematic diagram showing a circuit constituting part of another conventional data driver.
Figure 4:
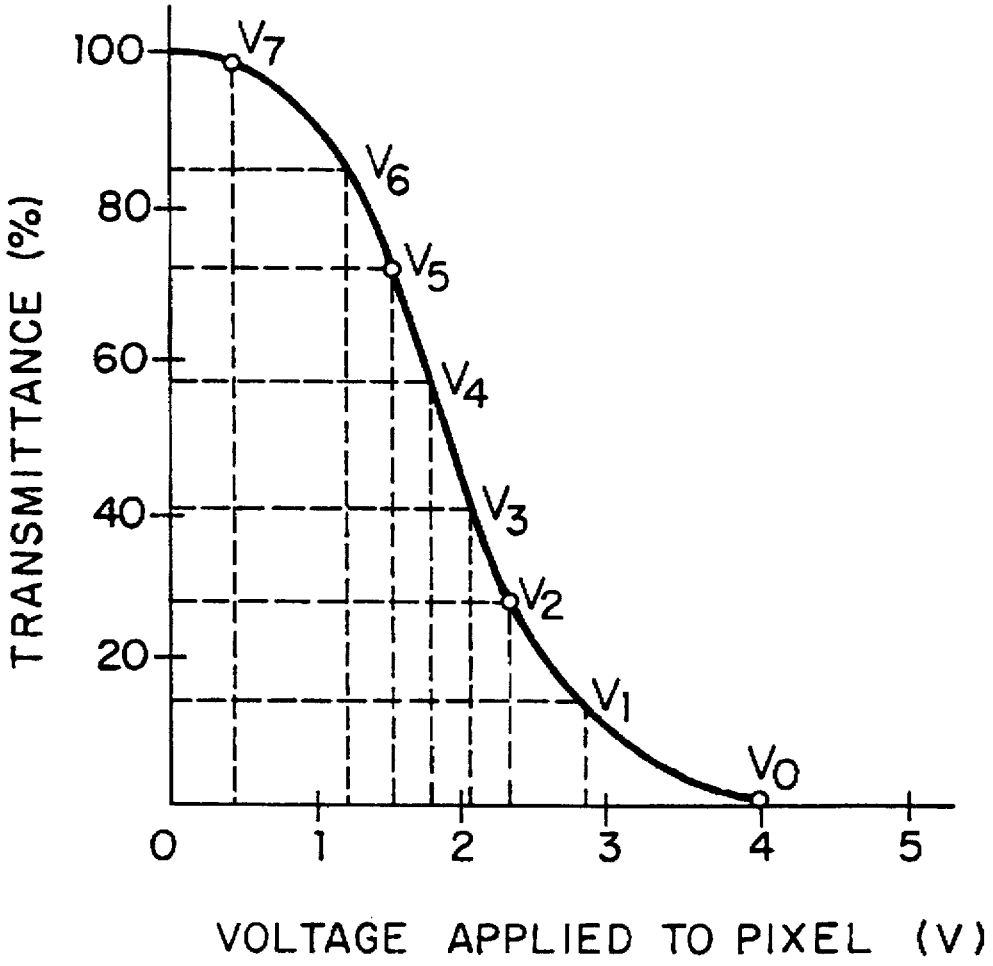
FIG. 4 is a graph showing the relationship between voltage applied to a pixel and the resultant transmittance of the pixel.
Figure 5:
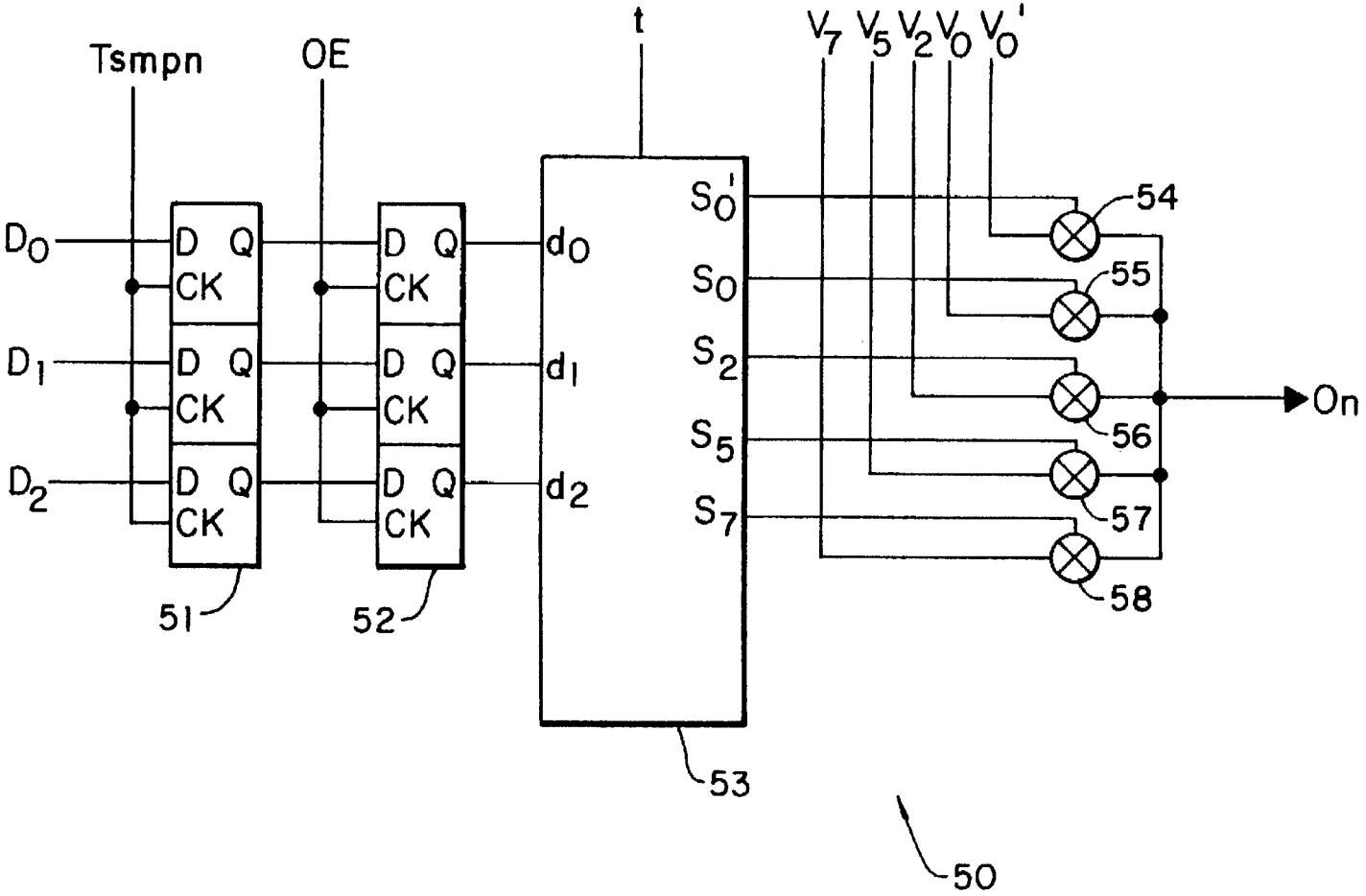
FIG. 5 is a schematic diagram showing a circuit constituting part of a data driver exemplifying a driving circuit according to the invention.

FIG. 5 shows the configuration of a circuit 50 which constitutes part of a data driver exemplifying a driving circuit according to the invention. The circuit 50 corresponds to the "n"th pixel of N pixels which are provided along each scanning line in a display apparatus (where N is a positive integer, and n is an integer of 1 to N). In this example, digital image data consists of three bits ($D_O$, $D_1$, $D_2$).

The circuit 50 includes sampling (primary) flip-flops 51 and holding (secondary) flip-flops 52 both for receiving and holding the digital image data. The circuit 50 also includes a selective control circuit 53, four analog switches 55 to 58 to which different gray-scale reference voltages are supplied, and an analog switch 54 to which a voltage different from the gray-scale reference voltages is supplied. The selective control circuit 53 turns on or off the analog switches 54 to 58 individually to control the on/off state thereof. The selective control circuit 53 receives a signal t. The output of the circuit 50 is connected to a data line (not shown), so that a voltage output from the circuit 50 is supplied through the data line to the "n"th pixel.

The term "gray-scale reference voltage" is herein defined as a voltage used to obtain at least one interpolated voltage by the oscillating voltage driving method disclosed in the above-described Japanese Patent Application No. 4-129164.

Next, the operation of the circuit 50 will be described with reference to FIG. 5. On receiving the leading edge of a sampling pulse $T_{smpn}$ corresponding to the "n"th pixel, the sampling flip-flops 51 obtain the respective bits of the digital image data ($D_0$, $D_1$, $D_2$), and hold the thus obtained data therein, thereby completing the sampling of the image data corresponding to the "n"th pixel. In the data driver, such image data sampling is performed for all the above-mentioned N pixels provided along a single scanning line (i.e., sampling corresponding to one horizontal period is performed). At the time when the sampling corresponding to one horizontal period is completed, an output pulse OE is applied to the holding flip-flops 52. On receiving the output pulse OE, the holding flip-flops 52 obtain the digital image data ($D_0$, $D_1$, $D_2$) from the sampling flip-flops 51, and also output the received digital image data to the selective control circuit The selective control circuit 53 is provided with input terminals $d_0$, $d_1$ and $d_2$, and output terminals $S_0'$, $S_0$, $S_2$, $S_5$ and $S_7$. The three bits of the digital image data ($D_0$, $D_1$, $D_2$) are respectively input through the input terminals $d_0$, $d_1$ and $d_2$ to the selective control circuit 53. Through the output terminals $S_0'$, $S_0$, $S_2$, $S_5$ and $S_7$, the selective control circuit 53 outputs control signals respectively for turning on or off the analog switches 54 to 58 to control the on/off state thereof. Gray-scale reference voltages $V_0$, $V_2$, $V_5$ and $V_7$ of different voltage levels are supplied to the analog switches 55 to 58, respectively. A voltage $V_0'$ which is different from the gray-scale reference voltages is supplied to the analog switch 54. The relationship among the levels of these voltages is: $V_0'>V_0>V_2>V_5>V_7$. Each of these voltages is output to the data line only when the corresponding analog switch 54, 55, 56, 57 or 58 is turned on.

Table 2 is a logical table showing the relationship between the inputs and outputs of the selective control circuit 53. The first section of Table 2 (i.e., the first three columns from the left) show the values of three bits which are respectively input to the input terminals $d_2$, $d_1$ and $d_0$ of the selective control circuit 53. The second section of Table 2 (i.e., the next five columns) show the values of control signals which are respectively output from the output terminals $S_0'$, $S_0$, $S_2$, $S_5$ and $S_7$ of the selective control circuit 53. Each of the analog switches 54 to 58 is turned on when it receives a control signal having a value of 1 from the output terminal $S_0'$, $S_0$, $S_2$, $S_5$ or $S_7$ connected thereto, and turned off when it receives a control signal having a value of 0 from the output terminal connected thereto. Each of the blanks in the second section of Table 2 indicates that the value of the control signal is 0. Each "t" indicates that the control signal has a value of 1 when the value of the signal t is 1, and that the control signal has a value of 0 when the value of the signal t is 0. Conversely, each $\bar{t}$ indicates that the control signal has a value of 0 when the value of the signal t is 1, and that the control signal has a value of 1 when the value of the signal t is 0.

TABLE 2

| $d_2$ | $d_1$ | $d_0$ | $S_0'$ | $S_0$ | $S_2$ | $S_5$ | $S_7$ |
|---|---|---|---|---|---|---|---|
| 0 | 0 | 0 | 1 | | | | |
| 0 | 0 | 1 | | $\bar{t}$ | t | | |
| 0 | 1 | 0 | | | 1 | | |
| 0 | 1 | 1 | | | t | $\bar{t}$ | |
| 1 | 0 | 0 | | | $\bar{t}$ | t | |
| 1 | 0 | 1 | | | | 1 | |
| 1 | 1 | 0 | | | | t | $\bar{t}$ |
| 1 | 1 | 1 | | | | | 1 |

Figure 6:
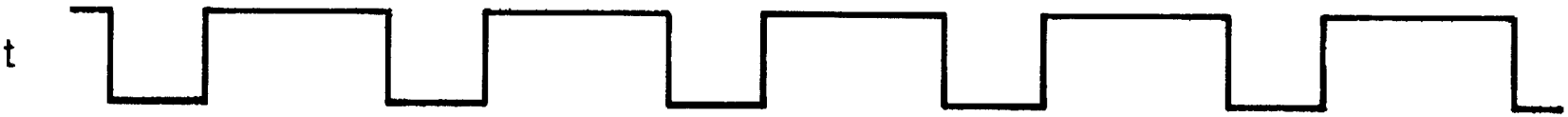
FIG. 6 shows the waveform of a signal t which is input to a selective control circuit 53 shown in FIG. 5.

FIG. 6 shows the waveform of the above-described signal t. The signal t is a pulse signal which periodically alternates between the values of 0 and 1 with a duty ratio of 1:2. Specifically, the ratio of the time for the signal t having a value of 0 to that for the signal t having a value of 1 is 1:2.

Next, the operation of the selective control circuit 53 will be described with reference to Table 2.

For example, in the case where the values of the three bits input to the input terminals $d_2$, $d_1$ and $d_0$ are 0, 0 and 1, respectively, the control signals output from the output terminals $S_0$ and $S_2$ have the values of the $\bar{t}$ and of the signal t, respectively. When the signal t has a value of 1, the analog switch 56 connected to the output terminal $S_2$ is turned on, with the other analog switches off, thereby allowing the gray-scale reference voltage $V_2$ to be output from the circuit 50 to the data line. When the signal t has a value of 0, the value of the $\bar{t}$ becomes 1, so that the analog switch 55 connected to the output terminal $S_0$ is turned on with the other analog switches off, thereby allowing the gray-scale reference voltage $V_0$ to be output from the circuit 50 to the data line. Since the value of the signal t periodically alternates between the values of 0 and 1 as described above, the voltage which is output from the circuit 50 to the data line becomes an oscillating voltage which oscillates between the gray-scale reference voltages $V_0$ and $V_2$ in the same cycle as that of the pulse signal t. The oscillating voltage thus applied through the data line to the pixel is an interpolated voltage of a level given by: $(V_0+2V_2)/3$, which is between the voltage levels of the gray-scale reference voltages $V_0$ and $V_2$.

In the same manner as described above, oscillating voltages which oscillate between the gray-scale reference voltages $V_2$ and $V_5$, and between the gray-scale reference voltages $V_5$ and $V_7$ are output from the circuit 50 to the data line and accordingly applied to the pixel. These oscillating voltages applied to the pixel are also interpolated voltages the levels of which are between the voltage levels of $V_2$ and $V_5$, and between the voltage levels of $V_5$ and $V_7$, respectively. Therefore, since the gray-scale reference voltages $V_0$, $V_2$, $V_5$ and $V_7$ are all used to obtain interpolated voltages, they cannot be adjusted separately from the interpolated voltages.

On the other hand, in the case where all the three bits input to the input terminals $d_2$, $d_1$ and $d_0$ of the selective control circuit 53 have a value of 0, a control signal with a value of 1 is output from the output terminal $S_0'$ of the selective control circuit 53, so that the analog switch 54 connected thereto is turned on. The other analog switches 55 to 58 remain off. As a result, the voltage $V_0'$ is output from the circuit 50 to the data line. The voltage $V_0'$ is not used to generate any oscillating voltage, so that it can be adjusted separately from all the other voltages. Therefore, the highest gray scale obtained by the use of the voltage $V_0'$ can be darkened without affecting the other gray scales, thereby enabling the display apparatus to produce a high-contrast display image.

Figure 7:
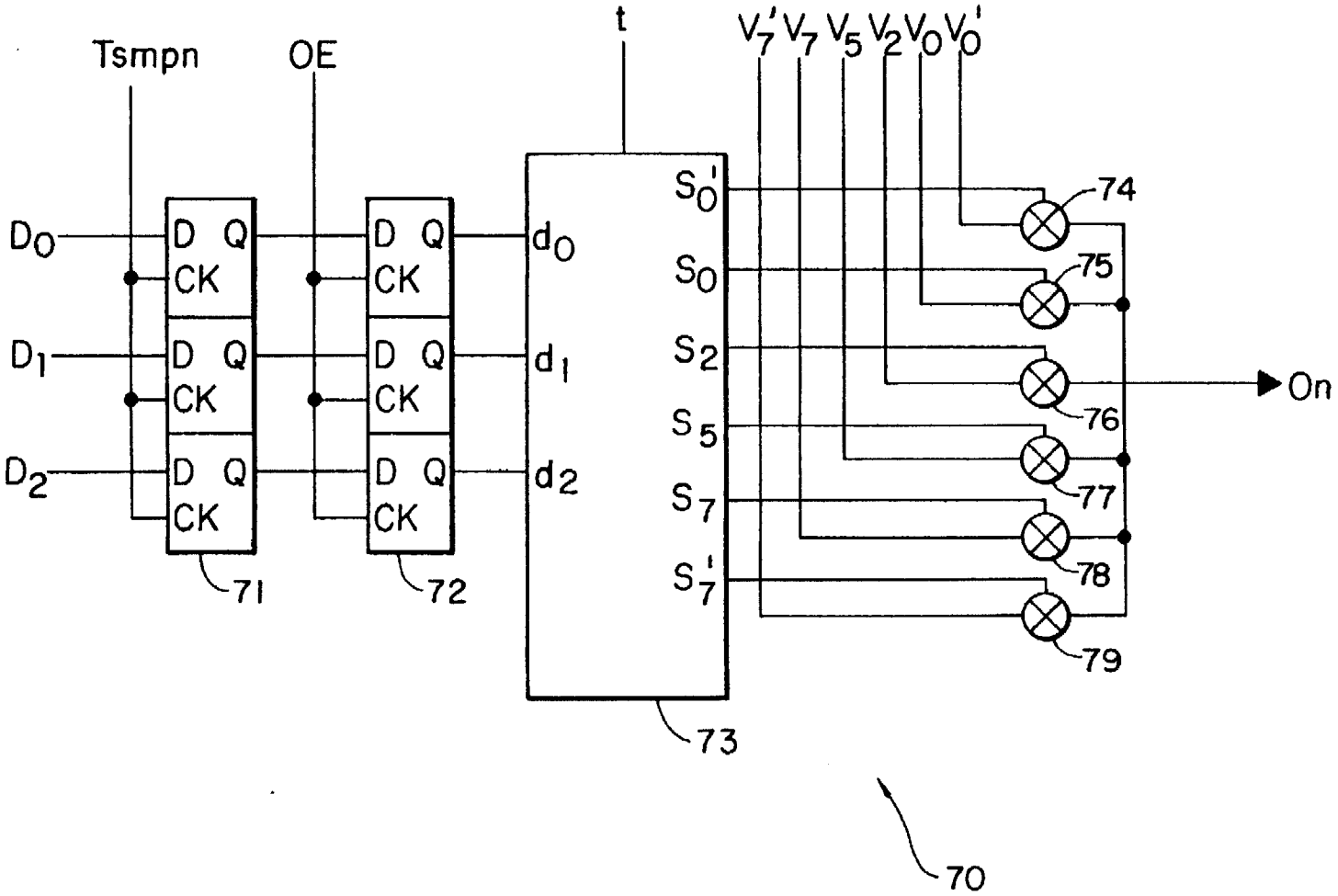
FIG. 7 is a schematic diagram showing a circuit constituting part of a data driver exemplifying another driving circuit according to the invention.

FIG. 7 shows the configuration of a circuit 70 which constitutes part of a data driver exemplifying another driving circuit according to the invention. The circuit 70 applies a voltage through a data line to the "n"th pixel of the N pixels provided along each scanning line in the display apparatus. The configuration of the circuit 70 is the same as that of the circuit 50 of FIG. 5, except that a selective control circuit 73 of the circuit 70 is provided with another output terminal $S_7'$ connected to an analog switch 79 to which another voltage $V_7'$ is supplied. The voltage $V_7'$ is different from all the gray-scale reference voltages $V_0$, $V_2$, $V_5$ and $V_7$, and also different from the voltage $V_0'$. The relationship among the levels of these voltages is: $V_0'>V_0>V_2>V_5>V_7>V_7'$. The detailed description of the other configuration of the circuit 70 is herein omitted.

In the same manner as the voltage $V_0'$ in the circuit 50 of FIG. 5, the voltage $V_7'$ can be adjusted separately from the other voltages. Therefore, the lowest gray scale obtained by the voltage $V_7'$ can be adjusted separately from the other gray scales. This will be described in detail below by reference to Table 3.

Table 3 is a logic table showing the relationship between the inputs and outputs of the selective control circuit 73. As shown in Table 3, in the case where the values of all the three bits respectively input to the input terminals $d_2$, $d_1$ and $d_0$ of the selective control circuit 73 are 1, a control signal having a value of 1 is output from the output terminal $S_7'$ of the selective control circuit 73, so that the analog switch 79 connected thereto is turned on. The other analog switches 74 to 78 remain off. Accordingly, the circuit 70 outputs the voltage $V_7'$ to the data line. The voltage $V_7'$ is not used to obtain any oscillating voltage, so that it can be adjusted separately from the other voltages.

TABLE 3

| $d_2$ | $d_1$ | $d_0$ | $S_0'$ | $S_0$ | $S_2$ | $S_5$ | $S_7$ | $S_7'$ |
|---|---|---|---|---|---|---|---|---|
| 0 | 0 | 0 | 1 | | | | | |
| 0 | 0 | 1 | | $\bar{t}$ | t | | | |
| 0 | 1 | 0 | | | 1 | | | |
| 0 | 1 | 1 | | | t | $\bar{t}$ | | |
| 1 | 0 | 0 | | | $\bar{t}$ | t | | |
| 1 | 0 | 1 | | | | 1 | | |
| 1 | 1 | 0 | | | | t | $\bar{t}$ | |
| 1 | 1 | 1 | | | | | | 1 |

Figure 8:
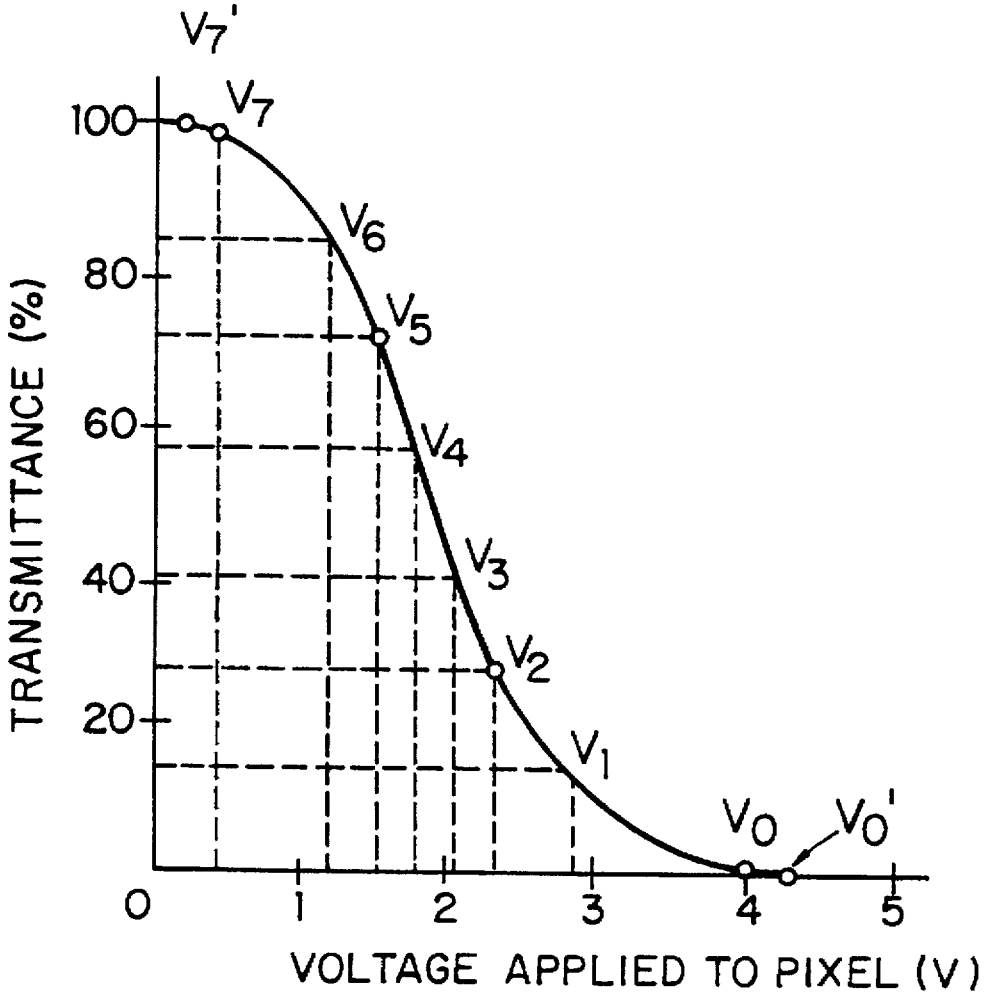
FIG. 8 is a graph showing the relationship between voltage applied to a pixel and the resultant transmittance of the pixel.

FIG. 8 shows the relationship between the voltage applied to the pixel by the above-described driving circuit of the invention including the circuit 70 of FIG. 7, and the resultant transmittance of the pixel. As apparent from FIG. 8, the voltage $V_0'$ is made higher than the highest gray-scale reference voltage $V_0$, while the voltage $V_7'$ is made lower than the lowest gray-scale reference voltage $V_7$. Thus, the voltages $V_0'$ and $V_7'$ are used to obtain the highest and the lowest gray scales, respectively. As described above, since the voltages $V_0'$ and $V_7'$ can be adjusted separately from the other voltages, the highest and the lowest gray scales respectively obtained by them can be adjusted without affecting the other gray scales. As a result, the display apparatus using this driving circuit can produce a display image having the highest contrast possible for a liquid crystal panel.

As described above, according to the invention, only the voltage $V_0'$ for the generation of the highest gray scale, or both the voltages $V_0'$ and $V_7'$ respectively for the generation of the highest and lowest gray scales are provided so as to be adjusted separately from the other voltages. Alternatively, only the voltage $V_7'$ for the generation of the lowest gray scale may be provided to be adjusted separately from the other voltages. In this case also, a high-contrast display image can be obtained in the display apparatus.

According to the invention, one or two additional voltages (i.e., the above-described voltages which can be adjusted independently for the generation of the highest and/or lowest gray scales) are supplied to the LSI circuit constituting the driving circuit (i.e., data driver), so that the number of the terminals of the LSI circuit and the number of the analog switches in the data driver are increased accordingly. Such increase, however, can never be significant. For example, in order to generate a display image with 64 gray scales from 6-bit digital image data, the conventional driving circuit using the oscillating voltage driving method requires nine voltage sources. In order to generate the same display image, a driving circuit of the invention using one additional voltage which can be adjusted independently for the generation of the highest or lowest gray scale requires only one more voltage source, i.e., ten voltage sources. Since the number of voltage sources is only increased from nine to ten, the number of input terminals of the LSI circuit is only increased from nine to ten, and the number of analog switches is increased by only one for each output terminal of the data driver. This indicates that the increase in the number of the terminals of the LSI circuit and in the number of analog switches due to the increase in the number of voltage sources is extremely small in the driving circuit of the invention.

As described above, according to the invention, one or two voltages different from the gray-scale reference voltages are provided to be adjusted independently. Therefore, a voltage for the generation of the highest or lowest gray scale, or voltages for the generation of both the highest and lowest gray scales can be adjusted separately from the other voltages. This enables the generation of a display image having the highest contrast possible for a liquid crystal panel, while maintaining the advantage of the oscillating voltage driving method where the number of gray scales which can be obtained is greater than that of the voltage sources.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit for a display apparatus including pixels which are allowed to produce a display image by specific voltages applied thereto, wherein the driving circuit comprises:

a first voltage output means for generating an interpolated voltage on the basis of gray-scale reference voltages applied thereto, and applying the interpolated voltage to said pixels via data lines, the interpolated voltage being of a level between the voltage levels of the gray-scale reference voltages; and a second voltage output means for applying, to said pixels via the data lines, a second voltage different from said gray-scale reference voltages, a voltage level of said second voltage being one of a voltage larger than a highest voltage level among said gray-scale reference voltages and said interpolated voltage and a voltage lower than a lowest voltage level among said gray-scale reference voltages and said interpolated voltage.

2. A driving circuit according to claim 1, wherein the second voltage applied to said pixels by said second voltage output means is used to obtain a highest gray scale.

3. A driving circuit according to claim 1, wherein the second voltage applied to said pixels by said second voltage output means is used to obtain a lowest gray scale.

* * * * *